US010604330B2

(12) United States Patent
Barrot et al.

(10) Patent No.: US 10,604,330 B2
(45) Date of Patent: Mar. 31, 2020

(54) APPARATUS FOR PLUGGING HOLES

(71) Applicants: Paul J. Barrot, Sunbury (AU); Helen Hatzistavros, Sunbury (AU); Paraterm Pty Ltd, Sunbury, Victoria (AU)

(72) Inventors: Paul J. Barrot, Sunbury (AU); Helen Hatzistavros, Sunbury (AU)

( * ) Notice: Subject to any disclaimer, the term of this patent is extended or adjusted under 35 U.S.C. 154(b) by 0 days.

(21) Appl. No.: 16/112,983

(22) Filed: Aug. 27, 2018

(65) Prior Publication Data

US 2019/0009974 A1 Jan. 10, 2019

Related U.S. Application Data

(63) Continuation of application No. 13/866,424, filed on Apr. 19, 2013, now abandoned.

(30) Foreign Application Priority Data

Apr. 21, 2012 (AU) ..... 2012901576
Apr. 12, 2013 (AU) ..... 2013204739

(51) Int. Cl.
*B65D 83/04* (2006.01)
*E04B 1/72* (2006.01)

(52) U.S. Cl.
CPC ..... *B65D 83/0409* (2013.01); *E04B 1/72* (2013.01)

(58) Field of Classification Search
CPC ..... E04B 1/72; B65D 83/0409
USPC ..... 221/197, 251, 232
See application file for complete search history.

(56) References Cited

U.S. PATENT DOCUMENTS 2,718,299 A * 9/1955 Atwater ..... B65D 83/0409 206/537
2,893,599 A * 7/1959 Kay ..... B65D 83/0409 221/260
2,907,327 A * 10/1959 White ..... A61M 37/0069 604/60
3,166,216 A * 1/1965 Guarr ..... B65D 83/0409 221/289
3,243,081 A * 3/1966 Schmank ..... B65D 83/0409 221/186
3,698,390 A * 10/1972 Ferris ..... A61J 7/0053 128/202.13
3,757,781 A * 9/1973 Smart ..... A61D 7/00 604/59
3,796,347 A * 3/1974 Hafner ..... B65D 83/0409 221/276
4,174,048 A * 11/1979 Volpe, Jr. ..... B65D 83/0409 206/537
4,438,867 A * 3/1984 Mayne ..... H05K 13/0447 221/197
4,474,308 A * 10/1984 Bergeron ..... A61J 7/0053 124/26
4,560,086 A * 12/1985 Stol ..... B65D 83/0409 198/724

(Continued)

*Primary Examiner* — Rakesh Kumar
(74) *Attorney, Agent, or Firm* — Cantor Colburn LLP

(57) ABSTRACT

An apparatus for plugging a hole, the apparatus including: a chamber for housing a plurality of plugs which are sized to fit the hole, the chamber having a feed channel to permit passage of plugs under gravity to a feed location at or near an end of the apparatus; a plug exit; a guide for positioning the apparatus such that the plug exit is at an entrance to, or is within, the hole; and a push rod for driving a plug from the feed location through the plug exit into the hole.

10 Claims, 6 Drawing Sheets

(56) References Cited

U.S. PATENT DOCUMENTS 4,808,166 A * 2/1989 Davidov ..... A61M 31/00 604/114
4,811,531 A * 3/1989 Vallerand ..... E04B 1/72 52/127.5
4,846,793 A * 7/1989 Leonard ..... A61M 37/0069 604/62
4,990,136 A * 2/1991 Geria ..... A61M 31/007 604/59
5,044,519 A * 9/1991 Aoyama ..... B23P 19/006 221/212
5,054,649 A * 10/1991 Lemaire ..... B23P 19/003 221/248
5,213,566 A * 5/1993 Weissenburger ..... A61F 13/26 222/386.5
5,405,324 A * 4/1995 Wiegerinck ..... A61B 17/3468 604/60
5,860,946 A * 1/1999 Hofstatter ..... A61M 31/007 604/15
6,572,527 B2 * 6/2003 Steele, Sr. ..... A61N 5/1007 600/7
6,644,497 B1 * 11/2003 Klundt ..... A63H 3/005 221/24
7,118,550 B2 * 10/2006 Loomis ..... A61F 13/26 604/60
7,273,158 B1 * 9/2007 Dean ..... A63B 47/002 221/270
7,494,296 B2 * 2/2009 Stahle ..... A47L 9/244 403/109.1
7,753,916 B2 * 7/2010 Weber ..... A61F 2/167 606/107
8,062,248 B2 * 11/2011 Kindel ..... B65D 83/0409 604/63
8,308,026 B2 * 11/2012 Rapko ..... B25B 9/00 206/37
8,545,554 B2 * 10/2013 Novakovic ..... A61F 2/1662 606/107
8,668,676 B2 * 3/2014 Chang ..... A61F 9/0017 604/274
2005/0109793 A1 * 5/2005 Thomas ..... E04H 4/1281 222/6
2005/0257675 A1 * 11/2005 Bassett ..... E21B 7/007 89/1.14
2007/0170202 A1 * 7/2007 Chen ..... A45C 11/00 221/267
2009/0314795 A1 * 12/2009 Rapko ..... B25B 9/00 221/251
2013/0292399 A1 * 11/2013 Barrot ..... E04B 1/72 221/1
2014/0353325 A1 * 12/2014 LaBruzza ..... E04G 17/0644 220/796
2019/0031425 A1 * 1/2019 Safdie ..... B65D 83/0409

* cited by examiner

APPARATUS FOR PLUGGING HOLES

RELATED APPLICATION DATA

This application claims priority under 35 U.S.C. § 119 to Australian patent application number 2012901576, filed on Apr. 21, 2012 and Australian patent application number 2013204739, filed on Apr. 12, 2013, the disclosures of which are incorporated herein by reference. This application is a continuation of U.S. application Ser. No. 13/866,424, filed on Apr. 14, 2013, the disclosure of which is incorporated herein by reference.

FIELD

The present invention relates to an apparatus for plugging holes, for example in the pest control industry. It has particular, though not exclusive, application in relation to termite control.

BACKGROUND

In the termite control industry, termite treatment of a dwelling is achieved by drilling holes into a concrete slab of the dwelling down to the underlying soil, injecting chemicals into the holes, plugging the holes and then re-concreting over the plugged holes. Australian Standard 3660.2 requires that chemical injection holes be drilled into concrete at 200 mm intervals. Accordingly, at a single treatment site there may be hundreds of holes which need to be sealed. At present a pest controller is required to kneel down and plug each hole manually. This is an extremely time-consuming and possibly injury-causing task.

Embodiments of the present invention seek to address the above long-standing difficulty, and in particular seek to provide a tool which plugs drilled holes quickly and with less effort than has been required previously.

SUMMARY

Accordingly, the present invention provides, in a first aspect, an apparatus for plugging a hole, the apparatus including a chamber for housing a plurality of plugs which are sized to fit the hole, the chamber having a feed channel to permit passage of plugs under gravity to a feed location at or near an end of the apparatus; a plug exit; a guide for positioning the apparatus such that the plug exit is at an entrance to, or is within, the hole; and a push rod for driving a plug from the feed location through the plug exit into the hole.

Advantageously, the guide allows the apparatus to quickly be positioned for delivery of a plug into a hole. Housing a plurality of plugs in a chamber with a gravity feed permits successive plugs to be delivered in highly efficient fashion.

In certain embodiments, the guide may comprise a tip of the push rod. In other embodiments, the guide may comprise a projecting shaft at the end of the apparatus, within which the push rod is slideable.

Preferably, the apparatus includes a plunger coupled to the push rod for driving the push rod. In these embodiments, the plunger has a withdrawn position, and a depressed position in which the push rod projects beyond the plug exit.

Preferably, the apparatus includes biasing means for biasing the plunger towards either the depressed position or the withdrawn position.

In certain embodiments, the biasing means biases the plunger to the depressed position, in which position the tip of the push rod protrudes beyond the plug exit. In these embodiments, withdrawing the plunger into the withdrawn position (against the bias) allows a plug to be loaded into the feed location, and subsequently releasing the plunger drives the push rod against the plug to force the plug to the plug exit.

In other embodiments, the biasing means biases the plunger to the withdrawn position, thereby allowing a plug to be loaded into the feed location. The plunger is then pushed into the depressed position to actuate the push rod and drive it against the plug, thereby to force the plug to the plug exit.

Preferably, the plugs are formed of a resilient material. They are preferably spherical.

Preferably, the feed location is defined by tapered sidewalls which narrow into a delivery channel which has the plug exit at one end. The delivery channel preferably has a width which is less than the diameter of the plugs.

Preferably, the apparatus includes at least one plug housed in the chamber.

In a third aspect, the present invention provides a method of plugging a hole, the method including providing an apparatus according to any of the above embodiments; positioning the guide in the hole; withdrawing the push rod to feed a plug into the feed location under gravity; and driving the push rod to force the plug through the plug exit into the hole.

In embodiments where the push rod is coupled to a plunger, the push rod may be driven by depressing the plunger. If the apparatus includes a biasing means, the push rod may be driven automatically by releasing the plunger subsequent to withdrawing the push rod (by withdrawing the plunger).

Other and further aspects and features of embodiments of the disclosed inventions will become apparent from the ensuing detailed description in view of the accompanying figures.

BRIEF DESCRIPTION OF THE DRAWINGS

Preferred embodiments of the present invention will now be described, by way of non-limiting example only, with reference to the accompanying drawings in which.

The drawings illustrate the design and utility of embodiments of the disclosed inventions, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments of the disclosed inventions and are not therefore to be considered limiting of its scope.

DETAILED DESCRIPTION OF THE ILLUSTRATED EMBODIMENTS

Figure 1:
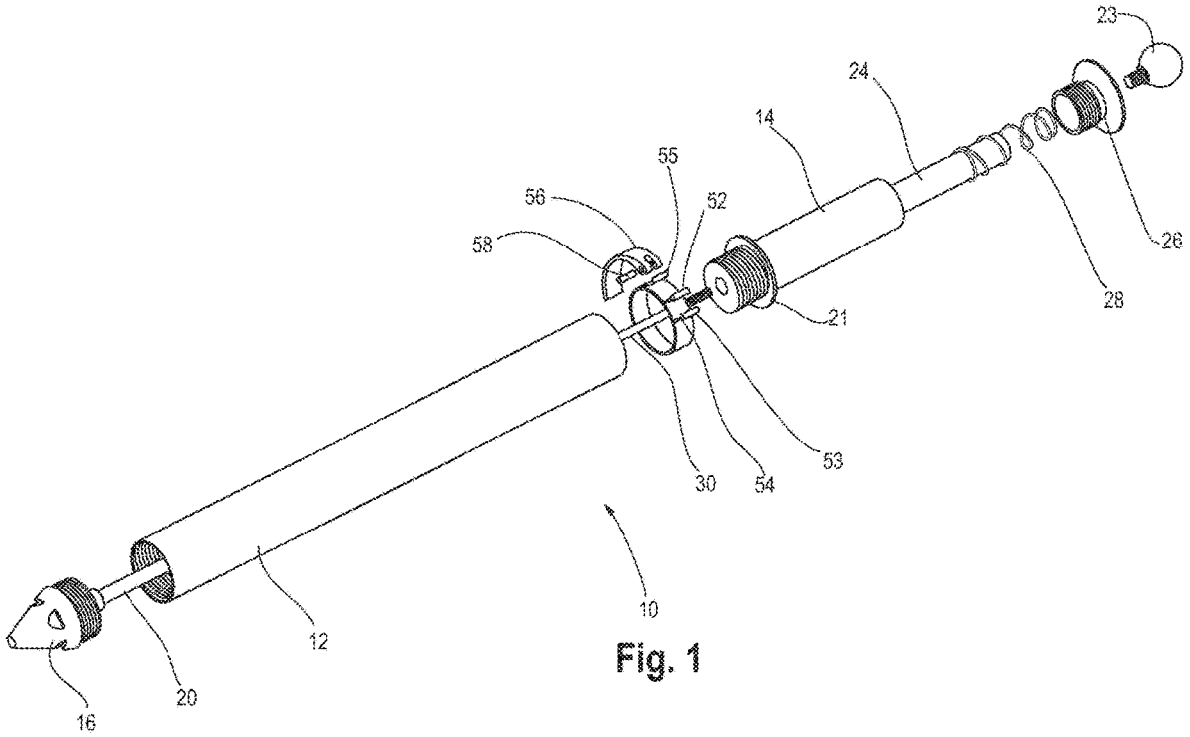
FIG. 1 is an exploded perspective view of an embodiment of an apparatus of the present invention.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

Various embodiments of the disclosed inventions are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention, which is defined only by the appended claims and their equivalents. In addition, an illustrated embodiment of the disclosed inventions needs not have all the aspects or advantages shown. An aspect or an advantage described in conjunction with a particular embodiment of the disclosed inventions is not necessarily limited to that embodiment and can be practiced in any other embodiments even if not so illustrated.

Embodiments of the invention will be described with reference to their application to treatment of buildings having a concrete slab which is to be used as part of a termite barrier. However, it will be appreciated that the invention may have application in any other context in which quick and efficient plugging of holes is required.

Referring to FIGS. 1 to 8, there is shown an apparatus 10 for plugging holes. The apparatus has a plug housing 12, a handle 14 and a head 16 which is attached to the plug housing 12 by screw-threaded engagement. The head 16 has a plug exit comprising a mouth 18 for delivering a plug to a hole as will later be described.

The handle 14 is attached to the plug housing 12 via a clamp assembly which includes a bracket 52 secured to housing 12 at its end adjacent handle 14, a screw 53 for threaded engagement with a pair of threaded apertures of the bracket 52 and a mounting plate 54, a nylon wear strip 55, and a lever 56 which is mounted to the clamp assembly via hinge pin 58. The lever 56 is rotated towards the housing 12 to a closed position to tighten the bracket 52, and conversely can be rotated away from the housing 12 to an open position to release the housing 12 from handle 14 to allow the store of plugs in housing 12 to be replenished.

In alternative embodiments, the handle 14 may be attached to the plug housing 12 by a wide variety of other mechanical connections known in the art, for example by way of a bayonet connection comprising pins projecting from the handle which are received in respective guide grooves in the housing (or vice versa), by a screw-threaded connection, or by an interference fit or snap fit.

Figure 5:
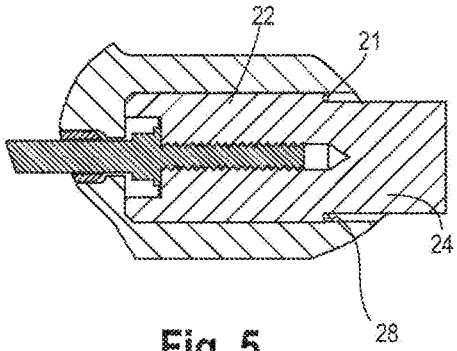
FIG. 5 is a detail of region 5 of the view of FIG. 2.

At an end of the apparatus 10 opposite the head, there is provided a stop 26. Also provided at that end is a plunger 24 which is used to drive push rod 30. Plunger 24 has a grip portion 23 at one end and a spring engagement portion 22 at the opposite end. As shown in FIGS. 1 and 5, spring engagement portion 22 has a shoulder 21 against which one end of spring 28 bears. The other end of spring 28 bears against stop 26. Accordingly, spring 28 biases the plunger 24 towards the closed configuration of the apparatus shown in FIGS. 2, 3 and 8.

Figure 3:
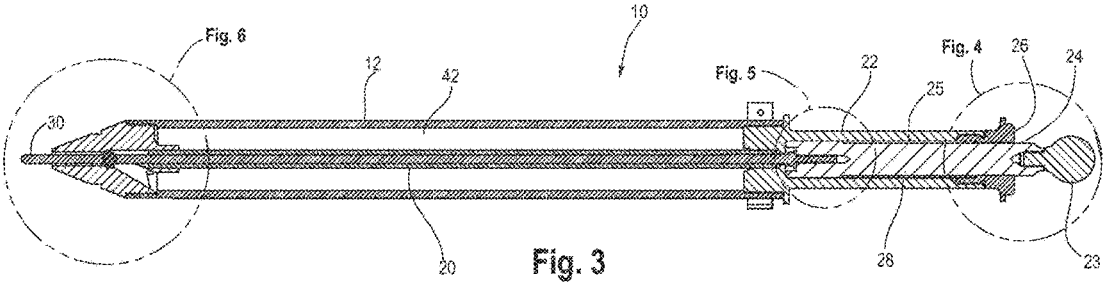
FIG. 3 is a section through the line 3-3 of FIG. 2.
Figure 4:
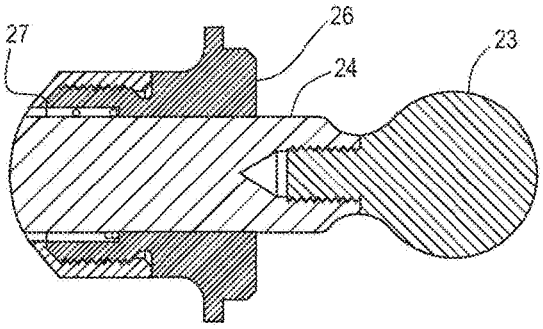
FIG. 4 is a detail of region 4 of the view of FIG. 2.

Referring now to FIG. 3, the plug housing 12 includes a hollow shaft 20 for receiving and allowing sliding movement of the push rod 30 along its length. The plug housing 12 defines a substantially annular chamber 42 around the shaft 20 for receiving a plurality of plugs. Preferably, the plugs are spherical plugs 50 of a resilient material such as rubber. The plugs may be hollow. The chamber 42 may be dimensioned to receive any number of plugs, depending on the plug size which in turn depends on the size of the holes to be plugged. For example, for a site treated according to AS3660.2, the holes will be approximately 12 mm diameter and the plugs may be sized slightly larger than this, for example to be of 14 mm diameter, such that they can be pushed into and engage with the sides of a 12 mm hole. An exemplary chamber 42 may have sufficient storage space for approximately 400 spherical plugs.

The apparatus 10 may be of any length, but is preferably dimensioned such that in use, plugs can be deployed without the user needing to bend his or her back. For example, the apparatus 10 from the mouth 18 to the end of plunger 24 (when stowed) may be approximately 1100 mm, with the grip being approximately 250 mm in length and the plug housing 12 being approximately 670 mm in length.

Figure 6:
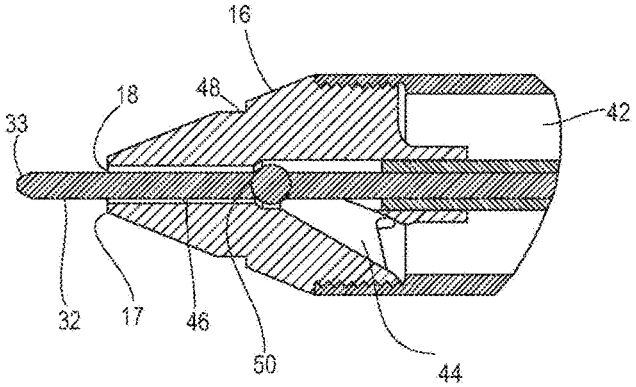
FIG. 6 is a detail of region 6 of the view of FIG. 2.

As shown in FIG. 6, the head 16 includes a channel 44 which is in communication with chamber 42 so as to be able to receive plugs 50 by a gravity feed. The head 16 also includes an exit channel 46 opening into mouth 18. The exit channel 46 is narrower than the diameter of plug 50 so that when a plug 50 drops into channel 44, it is prevented from exiting through mouth 18 unless forced by push rod 30. The opening of exit channel 46 may have a tapered section 48 in which a plug 50 can sit.

Handle 14 is hollow and has a space 25 within which plunger 24 can slide. Plunger 24 includes spring engagement portion 22 at an end distal to grippable portion 23. The spring engagement portion 22 has a shoulder 21 on which one end of spring 28 can bear, the spring 28 encircling an intermediate section of the plunger 24 between the shoulder 21 and the stop 26. The end of push rod 30 is received in a slot inside plunger 24.

Push rod 30 has a tip 32 with a slight taper 33 to assist placement of the tip 32 in a hole. Preferably, the tip 32 is reinforced to make it more resistant to damage if the apparatus 10 is dragged along the ground as it is moved between drilled holes. The apparatus 10 is configured such that the tip 32 projects a predetermined distance beyond the mouth 18, such that plugs 50 can be delivered to a predetermined depth within a hole. The projecting length of the tip 32 may be adjustable, for example by screw-threaded adjustment of the push rod 30 within plunger 24. Alternatively, the amount by which the tip 32 protrudes may be adjustable by providing a number of different heads 16, having varying lengths. For example, a shorter head could be provided to allow a greater length of push rod 30 to protrude, and thereby increase the depth to which a plug can be delivered.

Figure 2:
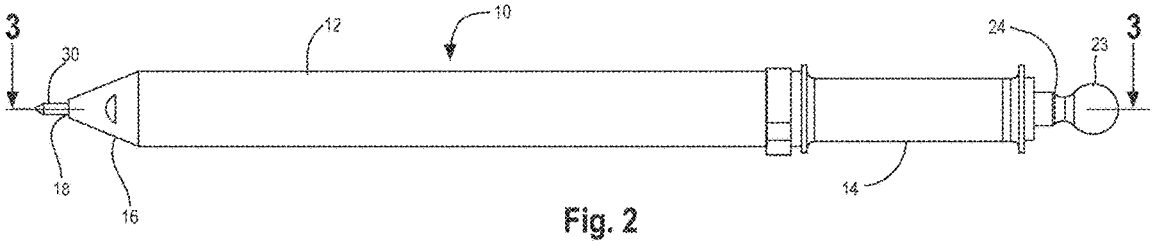
FIG. 2 is a side projection view of the apparatus of FIG. 1.
Figure 7:
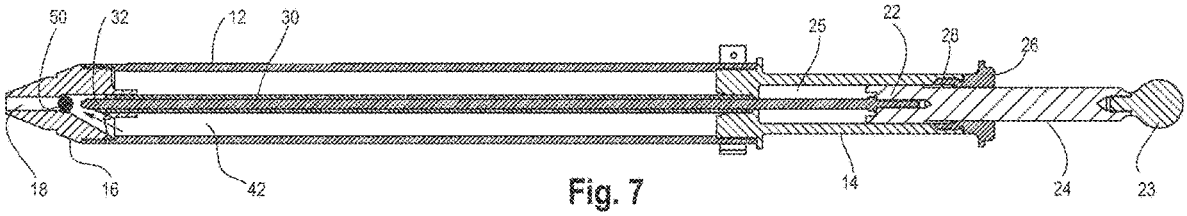
FIG. 7 is a sectional view of the apparatus in an open configuration with its plunger withdrawn.
Figure 8:
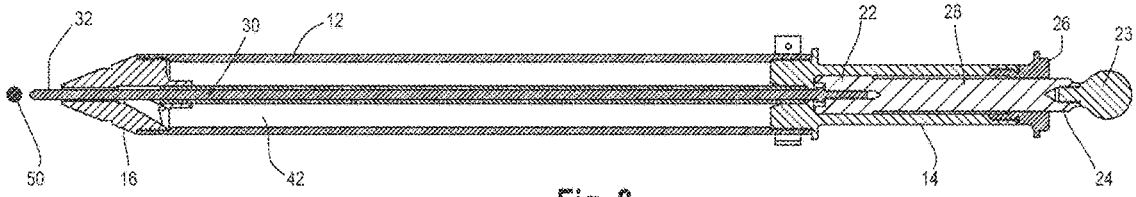
FIG. 8 is similar to FIG. 7, but shows the apparatus in a closed configuration.

In use, the apparatus 10, in the closed configuration shown in FIGS. 2 and 3 with tip 32 protruding from the mouth 18, is positioned such that tip 32 sits inside a drilled hole, and flat surface 17 of the head 16 rests against the ground surface adjacent to the hole. The tip 32 therefore acts as a guide. Plunger 24 is then withdrawn, as shown in FIG. 7, so that a plug 50 from chamber 42 can fall into the entrance of exit channel 46 as described above. In the withdrawn position, the tip 32 of push rod 30 is positioned just behind the plug 50. As plunger 24 is retracted, spring engagement portion 22 is withdrawn towards stop 26 and the spring 28 in handle 14 is compressed. Accordingly, release of the plunger 24 will allow a restoring force to act to drive the push rod 30 within shaft 20, such that the tip 32 contacts plug 50 and drives it out through plug exit (mouth) 18 (FIG. 8) and into the hole. The apparatus 10 can then be withdrawn, positioned within the next drilled hole and the process repeated.

Advantageously, the depicted embodiment allows plugs to be delivered with two simple movements: positioning the protruding rod tip 32 into a hole, and withdrawing/releasing the plunger 24 to deliver the plug (via the restoring force provided by the spring).

Figure 9:
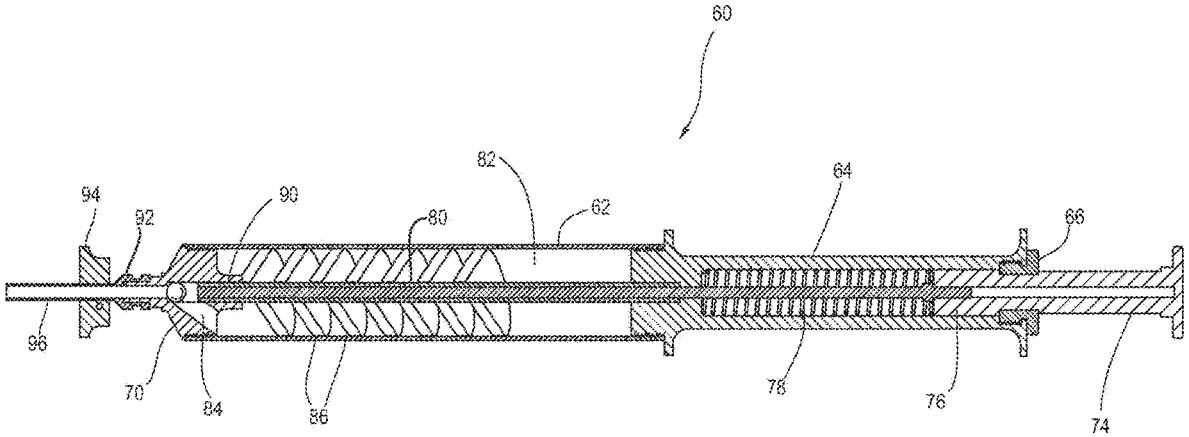
FIG. 9 is a cross-section through another embodiment of the apparatus of the present invention.
Figure 10:
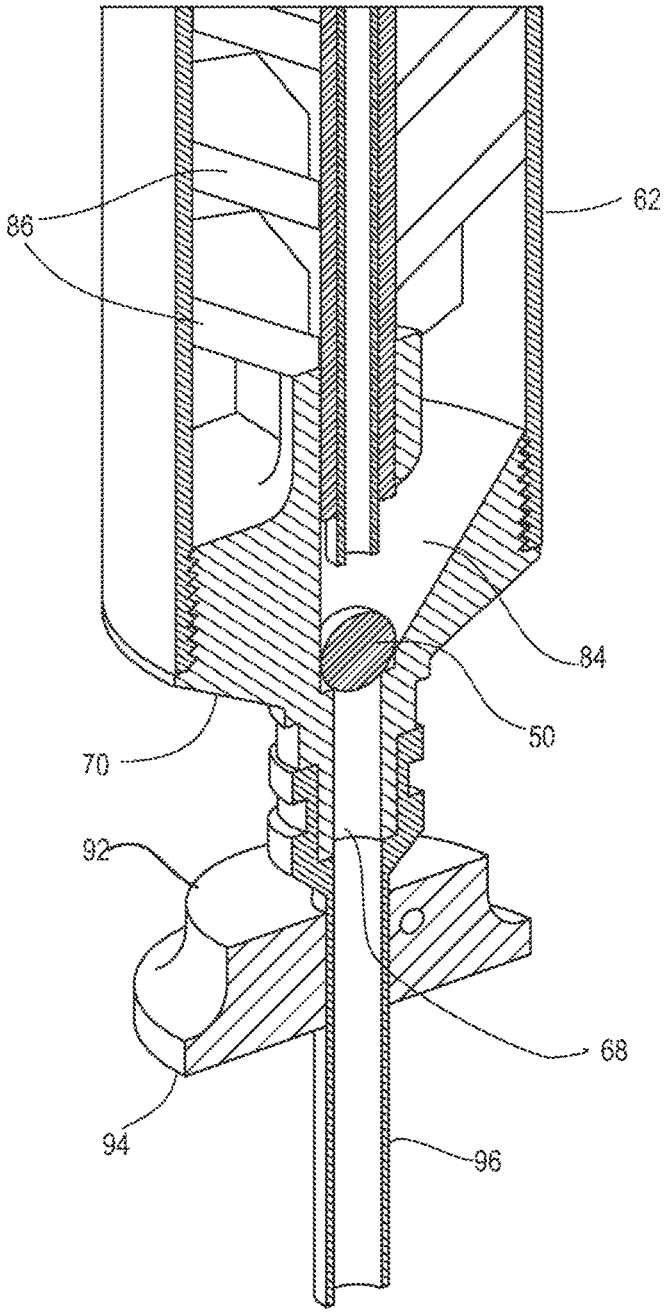
FIG. 10 is a close-up view, in section, of an end of the apparatus of FIG. 9.

Referring now to FIGS. 9 and 10, there is shown an alternative embodiment of an apparatus for plugging holes, generally indicated by reference numeral 60. The apparatus 60 has a head 70 connected to a plug housing 62 with a chamber 82 for receiving a plurality of plugs. The chamber 82 may include a helical passageway defined by walls 86, along which spherical plugs may travel. The helical passageway may assist in preventing jamming of the apparatus, by slowing the rate at which plugs 50 descend, and therefore reducing the possibility of more than one plug entering the channel 44. It has been advantageously found, however, that the helical passageway can be omitted without any appreciable jamming problem occurring, thus allowing for a simpler plug housing to be adopted as in the embodiment of FIGS. 1 to 8 for example.

Plug housing 62 includes a hollow shaft 80 to receive push rod 90 for sliding movement therein. Chamber 82 surrounds the shaft 80 and opens into a channel 84 which allows plugs to be gravity-fed to a tapered section near a mouth 68, similar to the arrangement described above.

Joined to head 70 (by any suitable means, e.g. interference fit, snap fit etc.) is a nozzle 92 having a depth stop 94 and a guide section 96. Nozzle 92 may be interchangeable with other like nozzles which have varying lengths of guide section 96 projecting beyond depth stop 94, so that the depth to which plugs 50 are delivered can be altered. In some embodiments, the nozzle 92 may be integral with the head 70.

The handle 64 is hollow and has a cavity for housing a spring 78 and a widened end 76 of the plunger 74. An end of push rod 90 is received in a shaft of plunger 74. An end of spring 78 bears against the widened end 76 of plunger 74, such that when plunger 74 is depressed to drive the push rod 90, spring 78 is compressed, and provides a restoring force to return plunger 74 to its original position when it is released, wherein the widened end 76 of the plunger 74 rests against a stop 66 which retains the spring 78 and the widened end 76 of the plunger 74 within the handle 64.

In operation, the guide portion 96 of nozzle 92 is positioned within a hole, until depth stop 94 bears against the surface adjacent the hole. Plunger 74 is then depressed, driving the push rod 90 within the shaft 80 until the tip of the push rod contacts the resilient plug 50. As plunger 74 continues to be depressed, the tip of the push rod 90 traverses mouth 68 and then the length of guide portion 96 until the plug 50 is ejected from the guide portion 96 into the hole. When plunger 74 is released, spring 78 returns it to its original position, allowing the next plug 50 to travel down channel 84 towards mouth 68.

It will be appreciated that various modifications, additions and alterations may be made to the invention by one skilled in the art without departing from the spirit and scope of the invention as defined in the appended claims.

Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

Although particular embodiments of the disclosed inventions have been shown and described herein, it will be understood by those skilled in the art that they are not intended to limit the present inventions, and it will be obvious to those skilled in the art that various changes and modifications may be made (e.g., the dimensions of various parts) without departing from the scope of the disclosed inventions, which is to be defined only by the following claims and their equivalents. The specification and drawings are, accordingly, to be regarded in an illustrative rather than restrictive sense. The various embodiments of the disclosed inventions shown and described herein are intended to cover alternatives, modifications, and equivalents of the disclosed inventions, which may be included within the scope of the appended claims.

The invention claimed is:

1. A termite control hole plugging apparatus for guided delivery of resilient and spherical plugs into holes in a concrete slab, the apparatus comprising:

a chamber adapted to house a plurality of resilient and spherical plugs sized to fit a termite control hole, the chamber having a feed channel to permit passage of the spherical plugs under gravity to a feed location, wherein the feed channel comprises a helical passageway;

a shaft passing though the chamber and terminating at a plug exit and operatively positioned at an entrance, or within the termite control hole; and a push rod slidable within the shaft for driving a plug from the feed location through the plug exit and into the termite control hole;

wherein the helical passageway, the shaft and the push rod are arranged on a common longitudinal axis.

2. A termite control hole plugging apparatus according to claim 1, including a plunger coupled to the push rod for driving the push rod.

3. A termite control hole plugging apparatus according to claim 2, wherein the plunger has a withdrawn position, and a depressed position in which the push rod projects beyond the plug exit.

4. A termite control hole plugging apparatus according to claim 3, wherein the apparatus includes biasing means for biasing the plunger towards either the depressed position or the withdrawn position.

5. A termite control hole plugging apparatus according to claim 4, wherein the biasing means biases the plunger to the depressed position, in which position a tip of the push rod protrudes beyond the plug exit.

6. A termite control hole plugging apparatus according to claim 5, wherein withdrawing the plunger into the withdrawn position causes a plug to be loaded into the feed location, and wherein subsequently releasing the plunger drives the push rod against the plug to force the plug to the plug exit.

7. A termite control hole plugging apparatus according to claim 1, wherein the feed location is defined by tapered sidewalls which narrow into one end of a delivery channel, the other end of the delivery channel opening into the plug exit.

8. A termite control hole plugging apparatus according to claim 7, wherein the delivery channel has a width which is less than a diameter of the plugs.

9. A termite control hole plugging apparatus according to claim 1, including at least one plug housed in the chamber.

10. A termite control hole plugging apparatus according to claim 1, wherein the helical passageway is defined by a pair of parallel walls.

* * * * *